US006587397B2

(12) United States Patent
Tsuchikiri

(10) Patent No.: US 6,587,397 B2
(45) Date of Patent: Jul. 1, 2003

(54) ELECTROACOUSTIC TRANSDUCER

(75) Inventor: Yoshikazu Tsuchikiri, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 10/013,524

(22) Filed: Dec. 13, 2001

(65) Prior Publication Data

US 2002/0074878 A1 Jun. 20, 2002

(30) Foreign Application Priority Data

Dec. 15, 2000 (JP) ..... 2000-382313

(51) Int. Cl.[7] ..... H04R 1/06
(52) U.S. Cl. ..... 367/188
(58) Field of Search ..... 367/188, 173, 367/165; 381/393; 310/81

(56) References Cited

U.S. PATENT DOCUMENTS

2002/0076079 A1 * 6/2002 Tsuchikiri et al. ..... 381/407

FOREIGN PATENT DOCUMENTS

JP 8-6558 1/1996

* cited by examiner

*Primary Examiner*—Daniel T. Pihulic
(74) *Attorney, Agent, or Firm*—Sughrue Mion, PLLC

(57) ABSTRACT

A case 1 is formed of thermoplastic resin, and includes an upper case 11 and a lower case 21. The case 1 accommodates a pole piece 31, a coil 41, a magnet 51, a diaphragm 61, and so on. The pole piece 31 includes an core 32 and a base 33, and placed on the lower case 21. There are integrally formed on an upper face of the lower case 21, a wall 22 for defining a mounting position of the pole piece 31, a projection 23 for preventing a conductive wire 42 drawn our from the coil 41 from getting in touch with the base 33, and a bobbin part 24 for the conductive wire 42 to be wound therearound. A height of the projection 23 is set at an equal or larger value to or than a height of a surface of the base 33, and a contact of the conductive wire 42 with the base 33 can be avoided by the projection 23.

6 Claims, 9 Drawing Sheets

ELECTROACOUSTIC TRANSDUCER

BACKGROUND OF THE INVENTION

1. Field of the Invention

The present invention relates to an electroacoustic transducer which transduces an electric signal to a sound.

2. Description of the Related Art

Japanese Patent Publication No. Hei.08-6558 discloses an electroacoustic transducer that comprises a case and a pole piece inside the case. The pole piece includes a base and a core integrally fixed to each other. A coil is disposed around the core. A magnet is disposed around the coil with a space from the coil. The coil is provided by directly winding a conductive wire around the core, or by mounting a prewound coil on the core.

However, the electroacoustic transducer faces such a problem that the conductive wire may get in touch with the base made of metal and causes friction therewith, when the conductive wire is wound around the core or a prewound coil is mounted, or when the end portions of the conductive wire forming the core are drawn out to be electrically connected to terminal parts. Consequently, the conductive wire, specifically an insulating layer thereof, maybe damaged. The damaged conductive wire may cause a short circuit when it comes into contact with the metallic parts of the base and so on. Such a short circuit may result in decrease in reliability and durability of the electroacoustic transducer.

SUMMARY OF THE INVENTION

The present invention has been made in view of the above described drawback, and an object of the invention is to provide an electroacoustic transducer which can prevent a damage of a conductive wire composing a coil, so that decrease in reliability and durability hardly occurs.

According to the invention, there is provided an electroacoustic transducer comprising:

a pole piece including a core and a base;

a coil composed of a winding of a conductive wire and disposed around the core;

a magnet disposed around the coil;

a guide part for preventing the conductive wire from getting in touch with the base, the guide part being formed of material having a lower hardness than the base.

In the electroacoustic transducer according to the invention, such an occurrence that the conductive wire drawn from the coil may get in touch with the base can be avoided by a presence of the guide part which is made of the material having a lower hardness than the base, and accordingly, the conductive wire (a coating layer thereof) can be prevented from being damaged through a contact with the base. As the results, there is no such a risk that the metallic parts of the base and so on may come into contact with the damaged conductive wire and a short circuit may occur or the conductive wire may be broken. Decrease in reliability and durability of the electroacoustic transducer can be thus restrained.

Preferably, the electroacoustic transducer further comprises a case includes an upper case, and a lower case having a coil terminal to which the end portion of the conductive wire is electrically connected, the base is placed on the lower case, and the guide part is provided on the lower case and has a height equal to or higher than a top surface of the base.

In this manner, a structure of the guide part which can prevent the conductive wire from getting in touch with the base can be realized in a simple form and at a low cost.

Preferably, the case is formed of resin material, and the guide part is provided on the lower case by being integrally formed therewith. Because the case is formed of resin material, and the guide part is integrally formed on the lower case, in this manner, there is no need of newly providing a component for constituting the guide part, nor an additional step of providing the guide part on the lower case by adhesion or the like. As the results, the guide part can be provided on the lower case in a simple form and at a low cost.

Further, the base is preferably formed with a cut out which can be engaged with the guide part. Since there is formed, in the base, the cut out which can be engaged with the guide part, positioning of the base can be reliably conducted. Moreover, by forming the cut out in the base, a capacity of the base can be decreased. As the results, a capacity of a rear space in the electroacoustic transducer can be increased, and its sound pressure performance, especially, the sound pressure performance in a bass range can be enhanced.

DETAILED DESCRIPTION OF THE PRESENT INVENTION

Figure 1:
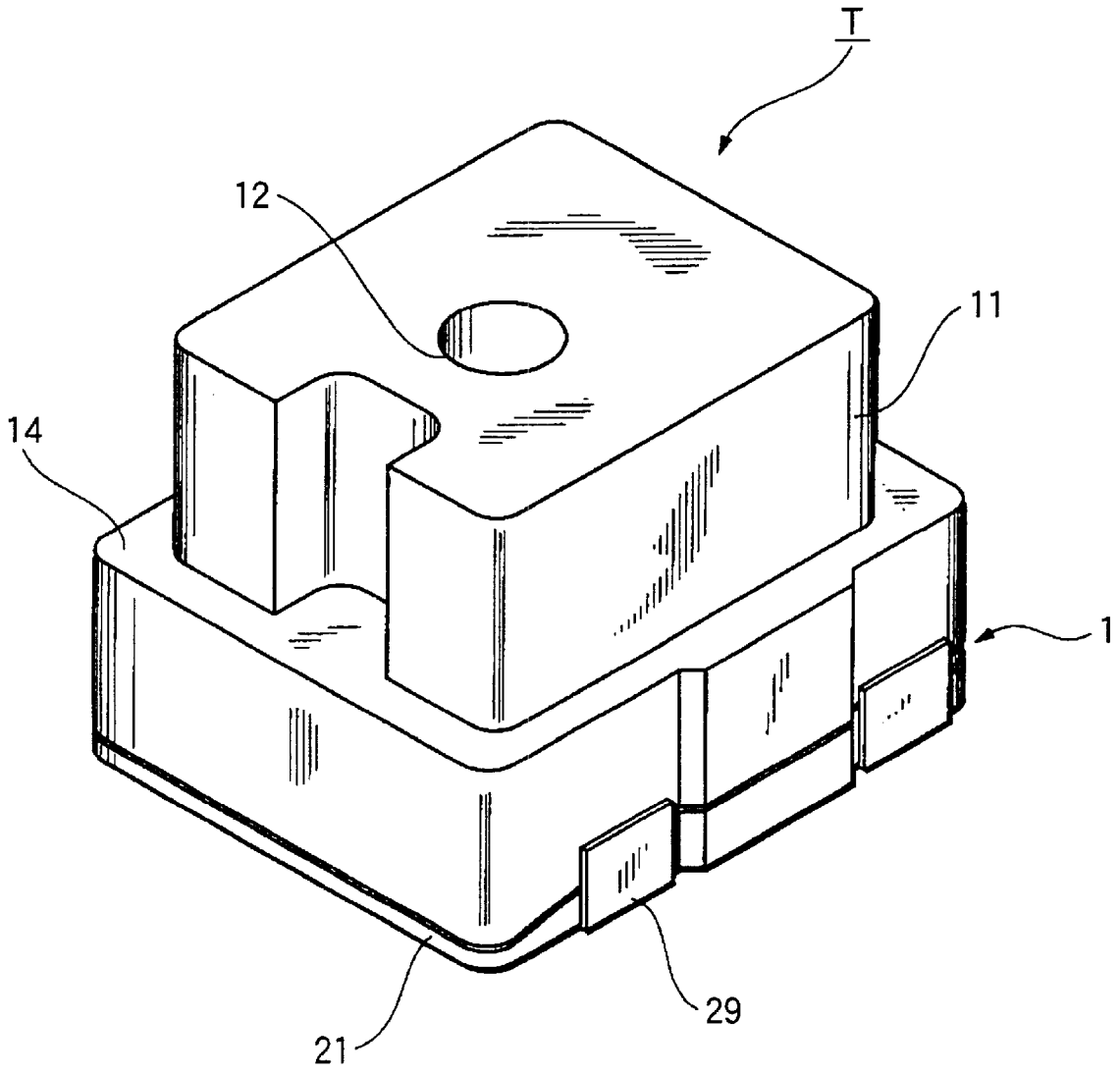
FIG. 1 is a perspective view showing an external view of an electroacoustic transducer in its entirety according to an embodiment of the invention.

An embodiment of the present invention will be described in detail with reference to the accompanying drawings. In the drawings, the same reference numerals will be assigned to the same elements, respectively, and the overlapped descriptions will be omitted.

Figure 2:
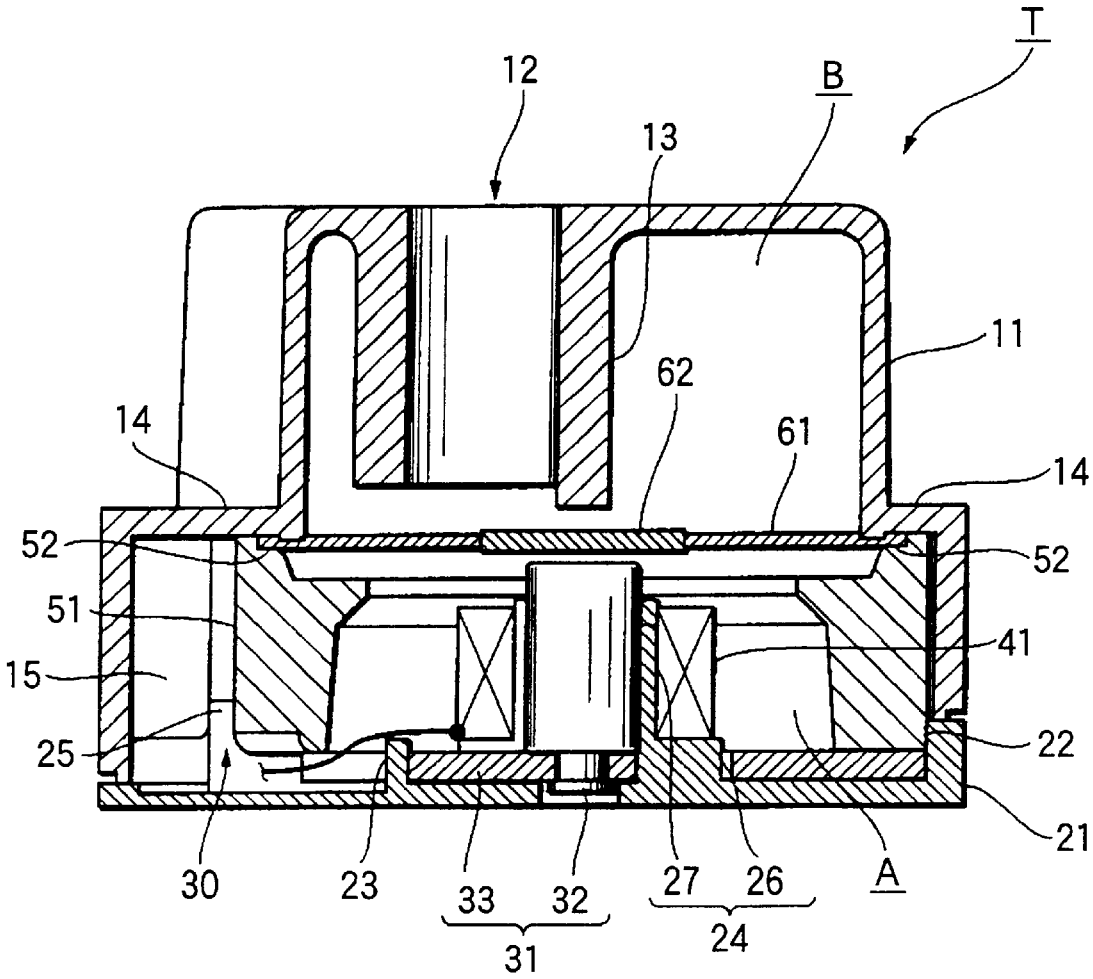
FIG. 2 is a sectional view showing the electroacoustic transducer according to the embodiment of the invention.
Figure 3:
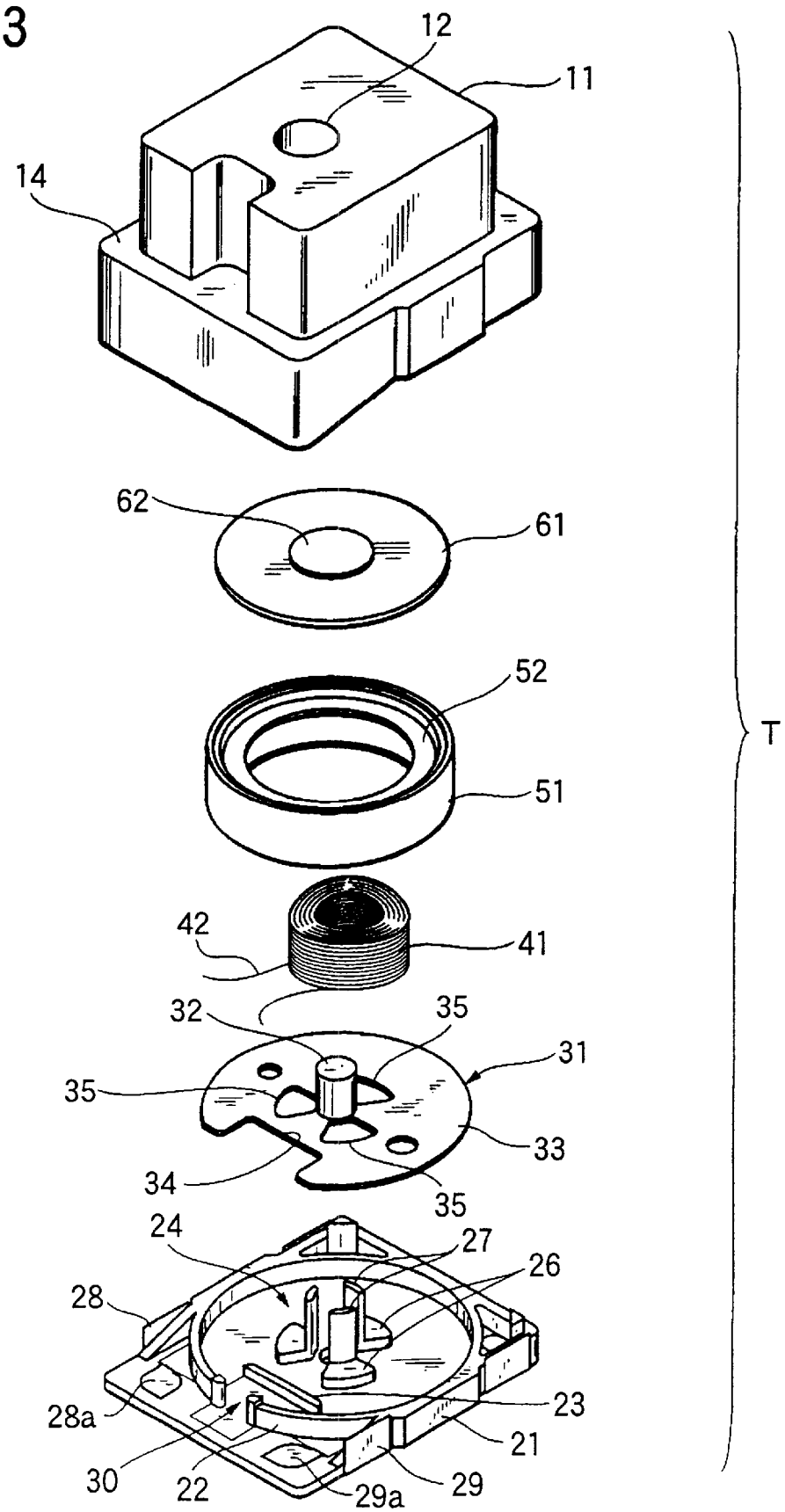
FIG. 3 is an exploded perspective view showing a structure of the electroacoustic transducer according to the embodiment of the invention.

FIG. 1 is a perspective view showing an external view of an electroacoustic transducer according to an embodiment of the invention. FIG. 2 is a sectional view of the electroacoustic transducer. FIG. 3 is an exploded perspective view showing the structure of the electroacoustic transducer.

An electroacoustic transducer T has a case 1 made of thermoplastic resin. The case 1 includes an upper case 11 and a lower case 21. The upper case 11 and the lower case 12 are joined and fixed to each other by employing ultrasonic welding technique. The upper case 11 has a substantially box-like shape. A lower face of the upper case 11 is opened. The upper case 11 has a sound emitting hole 12 in the upper face thereof and a sound emitting tube 13 extending toward the inside thereof. The uppercase 11 has a stepped portion 14 with which an ultrasonic welding machine is brought into contact. A pole piece 31, coil 41, magnet 51 and diaphragm 61 is accommodated in an internal space defined by the upper case 11 and the lower case 21.

Figure 4:
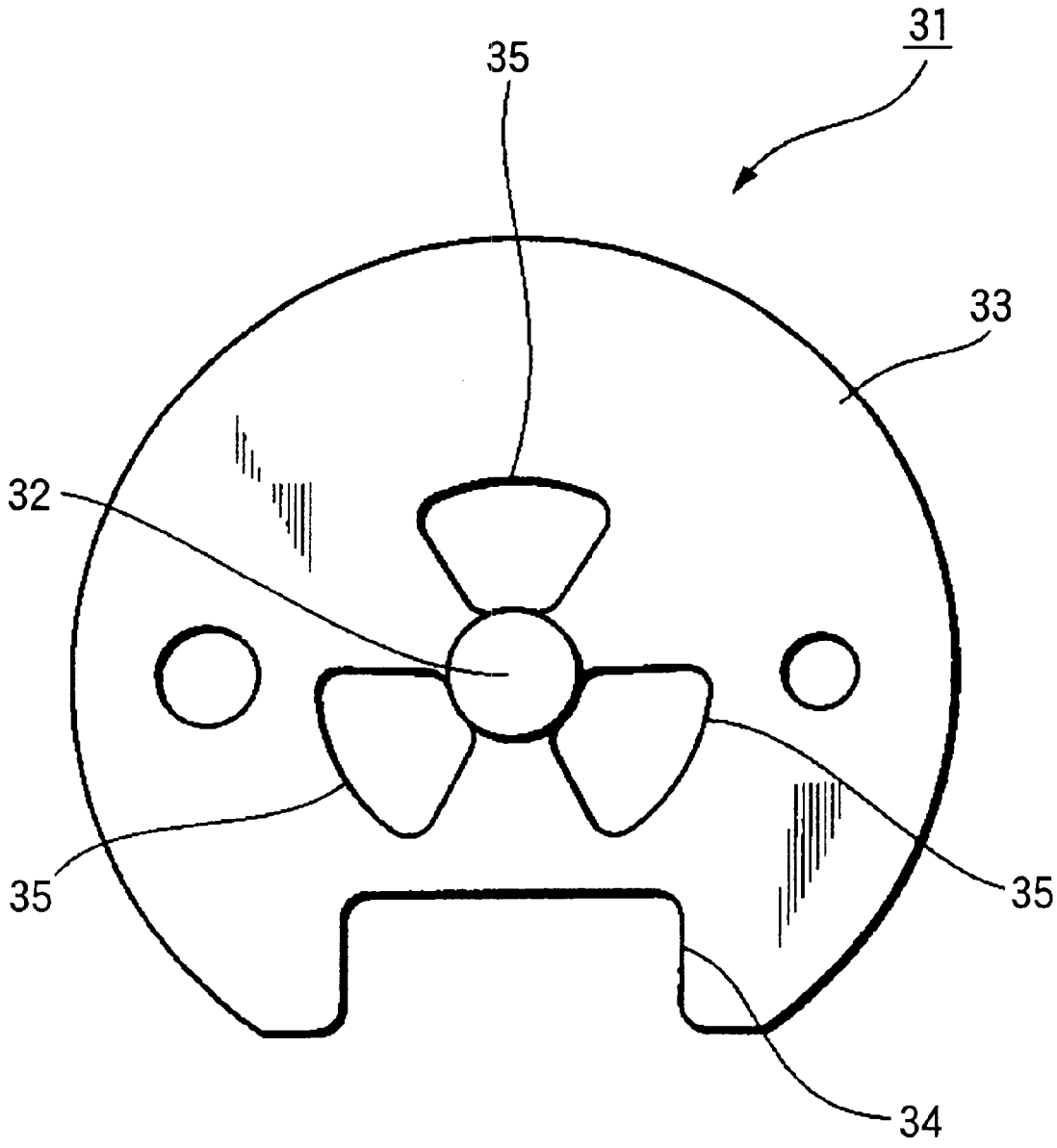
FIG. 4 is a plan view of a pole piece included in the electroacoustic transducer according to the embodiment of the invention.
Figure 5:
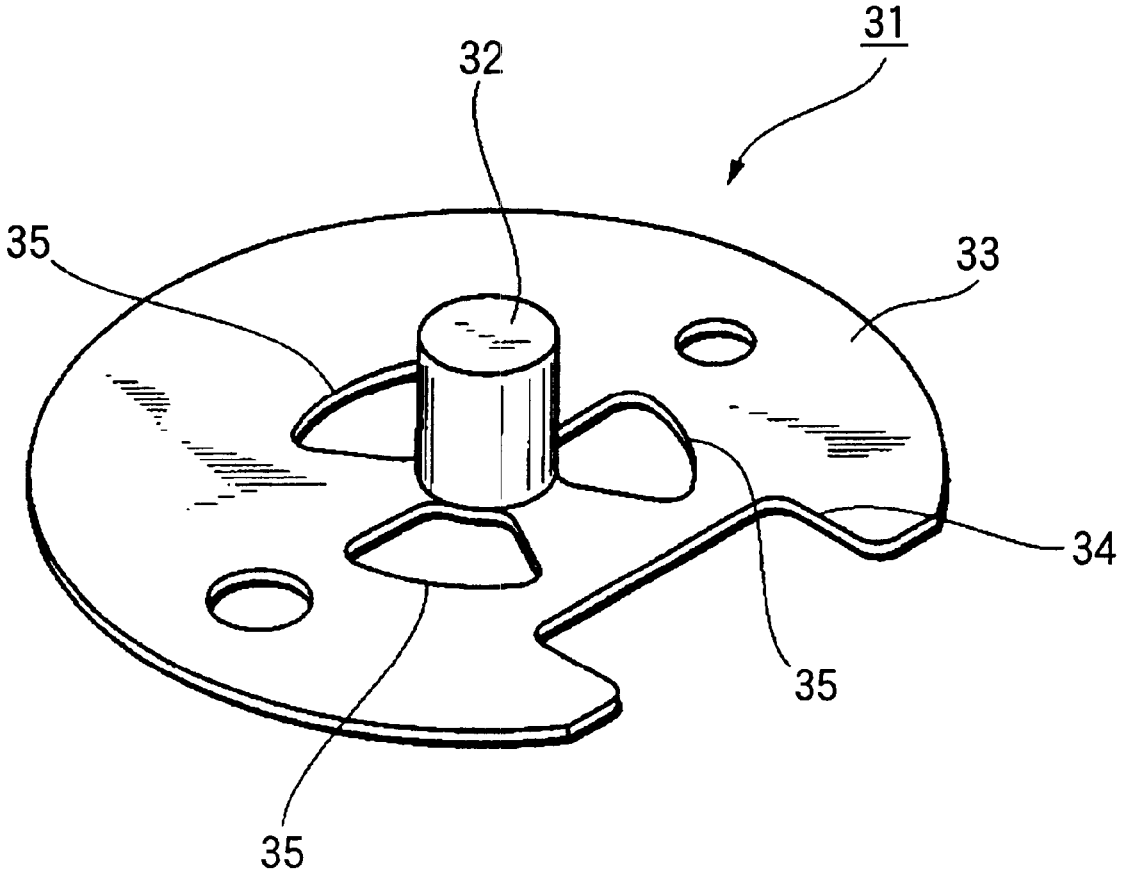
FIG. 5 is a perspective view of the pole piece included in the electroacoustic transducer according to the embodiment of the invention.

The pole piece 31 is placed on the lower case 21. The pole piece 31 has a core 32 in a substantially columnar shape and a base 33 made of metallic material (for example, permalloy or the like), as shown in FIGS. 4 and 5. The core 32 is caulked and integrally fixed to a center part of the base 33. A cut out 34 is formed at a predetermined position of a rim of the base 33. The base 33 defines a plurality of holes 35 (three holes in the embodiment) around the position to which the core is fixed. A bobbin part 24 is adapted to pass through the holes 35, which will be described later. In this embodiment, a thickness of the base 33 is set to be about 0.6 mm, and a length of the core 32 from an upper face of the base 33 (a height of the core 32) is set to be about 3.8 mm.

Figure 6:
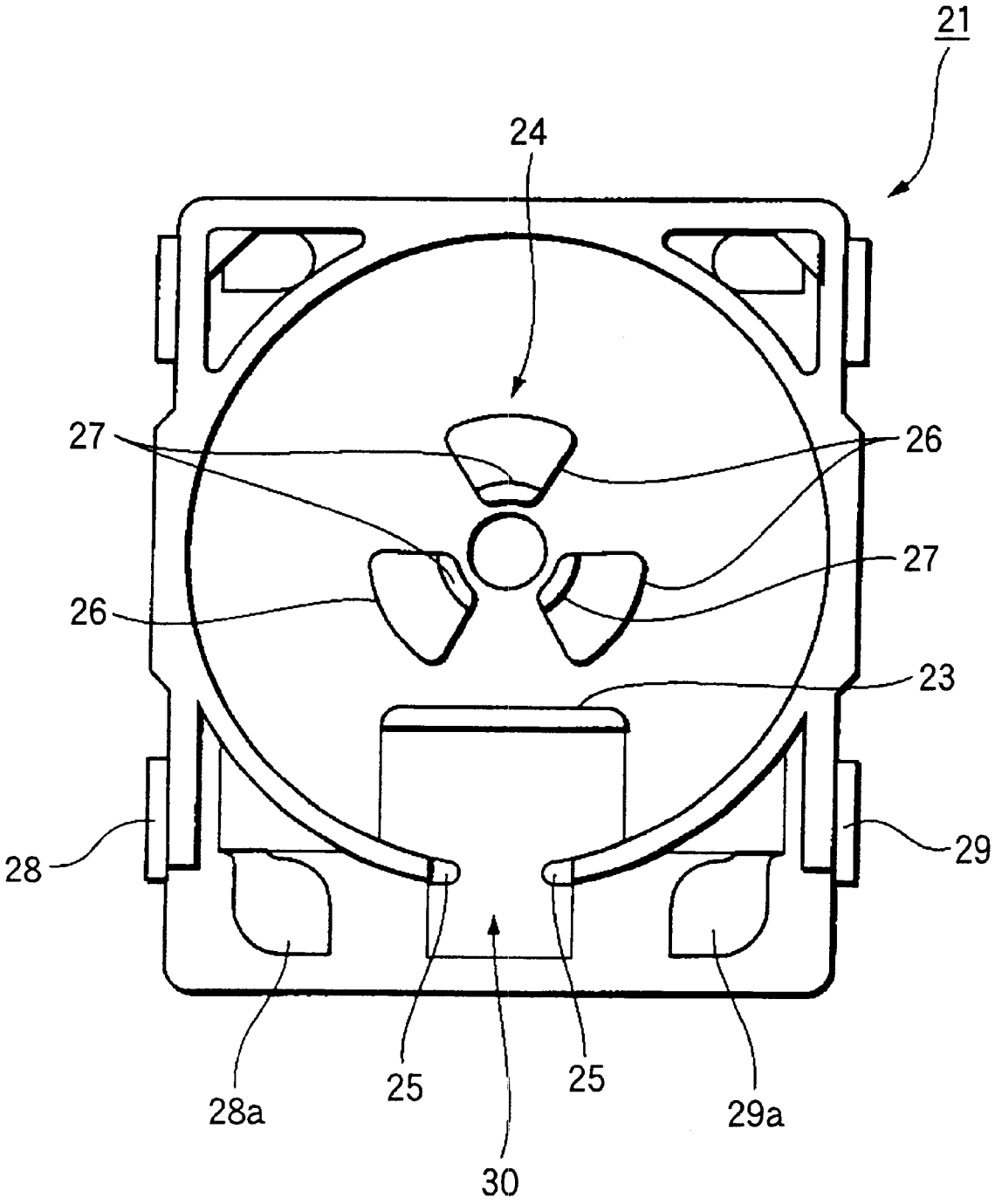
FIG. 6 is a plan view of a lower case included in the electroacoustic transducer according to the embodiment of the invention.
Figure 7:
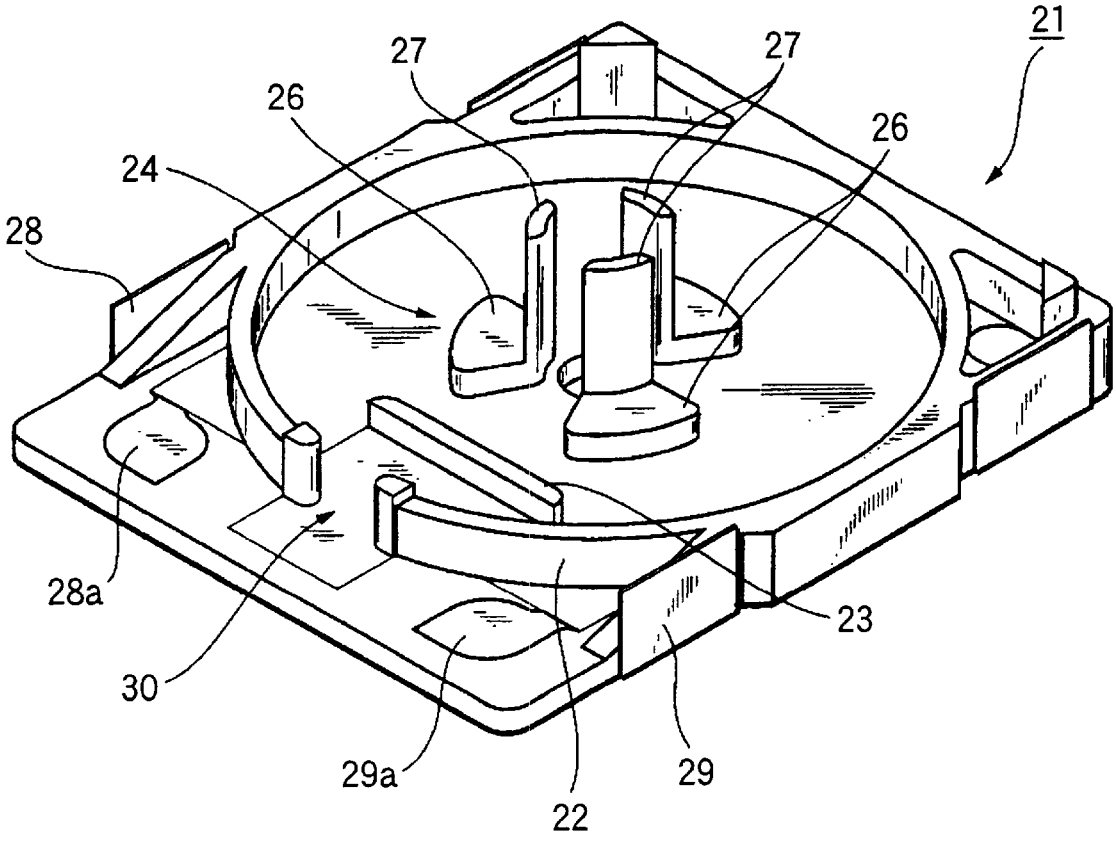
FIG. 7 is a perspective view of the lower case included in the electroacoustic transducer according to the embodiment of the invention.

A wall 22, a projection 23 and the bobbin part 24 are integrally formed on an upper face of the lower case 21 as shown in FIGS. 6 and 7. The wall 22 defines a mounting position of the pole piece. The projection 23 prevents a conductive wire 42 that forms a coil 41 from getting in touch with the base 33. The conductive wire 42 is adapted to be wound around the bobbin part 24. The wall 22 has projections 25 engagable with projections 15 that are formed in the upper case 11. The upper case 11 is positioned relative to the lower case 21 by engaging the projections 15 with the projections 25. Heights of the wall 22 and the projection 23 are set larger than a height of a surface of the base 33. In the embodiment, the height of the wall 22 is set to be about 1.2 mm, and the height of the projection 23 is set to be about 0.8 mm. The projection 23 is engagable with the cut out 34 of the base 33.

The bobbin part 24 extends from an upper face of the lower case 21 toward the internal space of the case 1 so as to surround an outer periphery of the core 32. The bobbin part 24 is divided into a plurality of pieces (three pieces in the embodiment) in a circumferential direction of the core 32. The bobbin part 24 has base portions 26 and extended portions 27. A height of the base portions 26 is set at a larger value (about 0.85 mm, in the embodiment) than the height of the surface of the base 33. A length of the extended portions 27 is set at such a value (about 2.95 mm, in the embodiment) that the top of the core 32 may project above ends of the extended portions 27 in a state where the pole piece 31 has been placed on the lower case 21. Moreover, an inner diameter of the bobbin part 24 (the base portions 26) is set at a value (about 2.2 mm, in this embodiment) substantially equal to an outer diameter of the core 32.

Faces of the base portions 26 opposed to the core 32 are curved along the outer periphery of the core 32. Faces of the extended portions 27 opposed to the core 32 and the reverse faces thereof (those faces around which the conductive wire 42 is wound) are also curved along the outer periphery of the core 32. A sectional area of the base portion 26 is set at a larger value than that of the extended portion 27. This structure can ensure mechanical strength of the bobbin part 24, and can prevent the bobbin part 24 from detaching from the lower case 21.

The bobbin part 24 (the extended portions 27) is passed through the holes 35 in the base 33 so that the bobbin part 24 (the extended portions 27) is positioned around the core 32. Then, the pole piece 31 (the base 33) is fitted to and mounted on the lower case 21 by being pressed from the above of the lower case 21. On this occasion, the cut out 34 of the base 33 is engaged with the projection 23 of the lower case 21 to position the pole piece 31 with respect to the lower case 21. In a state where the pole piece 31 is fitted in the lower case 21, the core 32 is pressed against the bobbin part 24, because the inner diameter of the bobbin part 24 (the base portions 26) is set at the value substantially equal to the outer diameter of the core 32. Accordingly, the pole piece 31 is not easily detached from the lower case 21.

Figure 8:
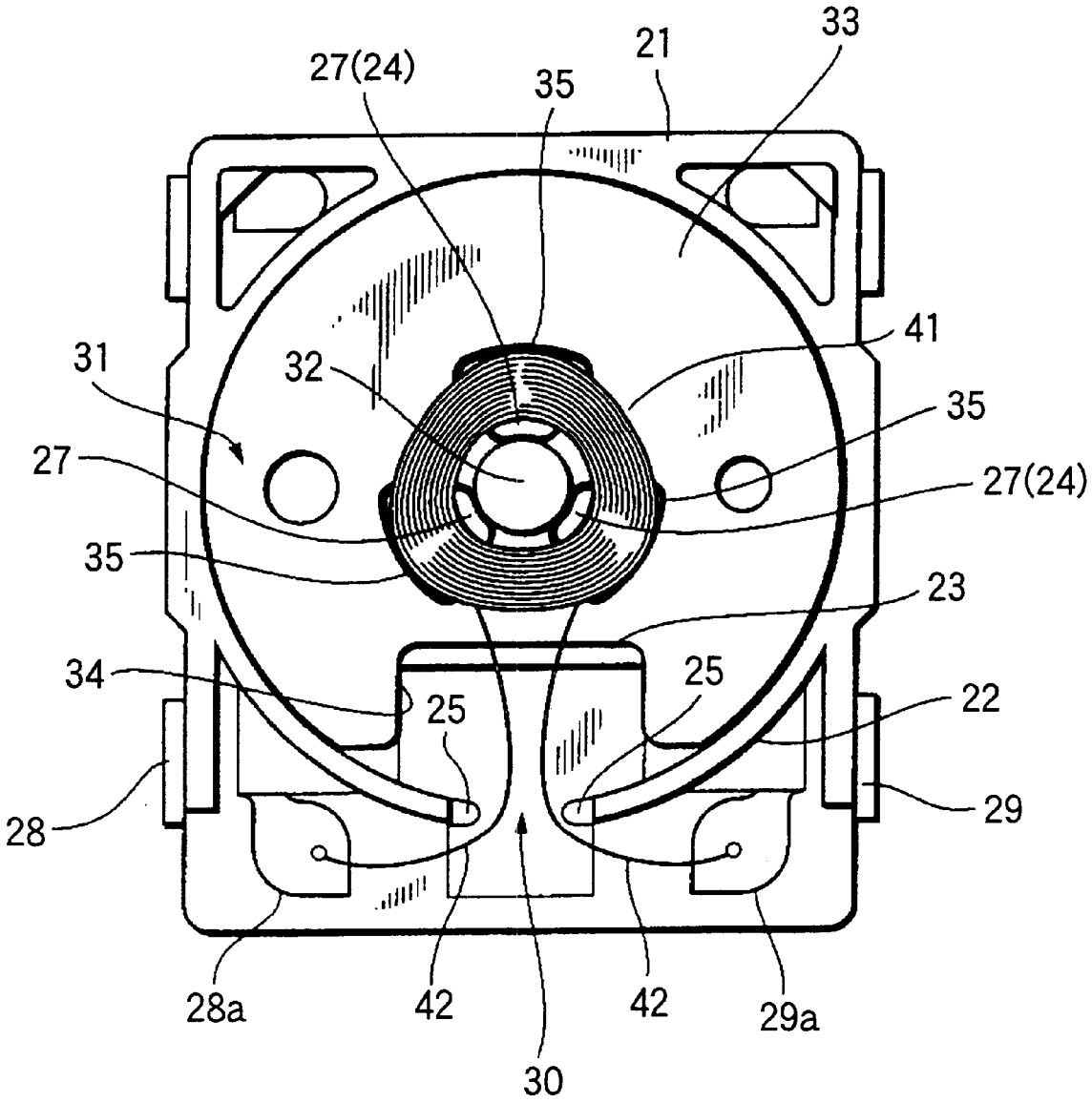
FIG. 8 is a plan view showing a state where a coil is formed by winding a conductive wire around a bobbin part in the electroacoustic transducer according to the embodiment of the invention.
Figure 9:
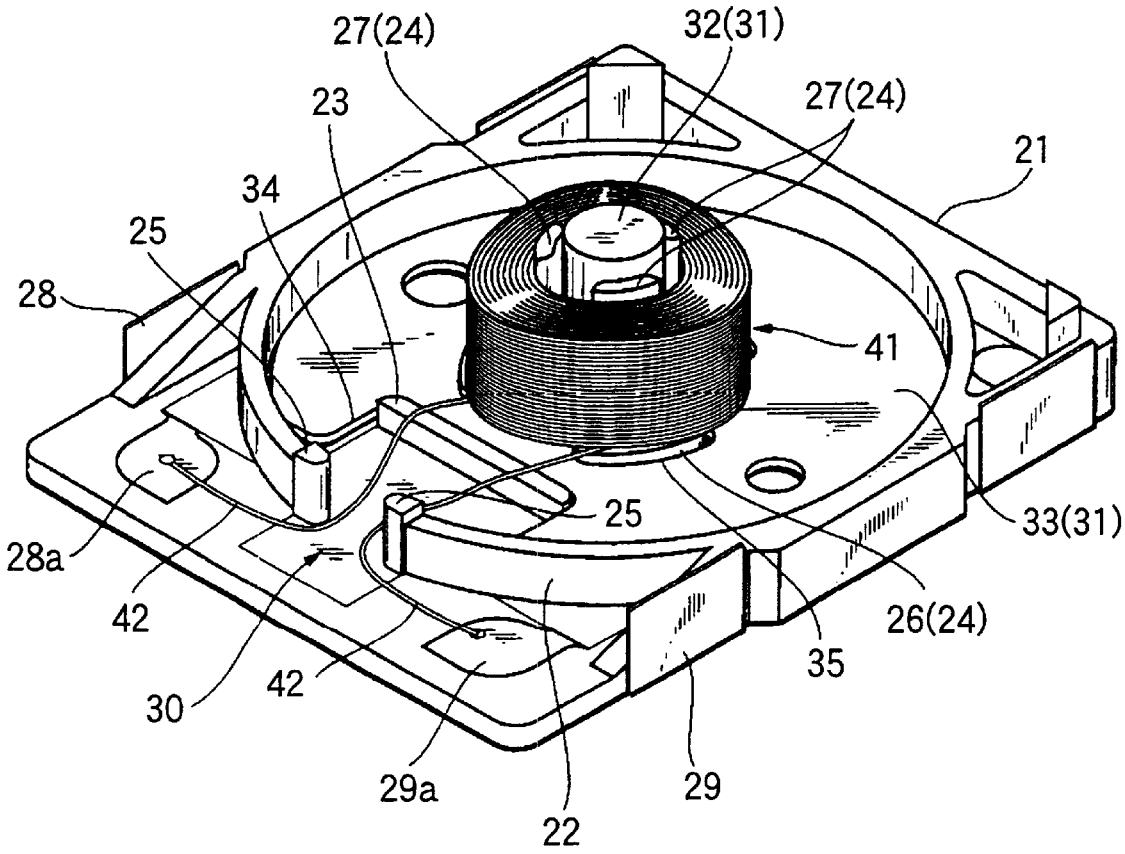
FIG. 9 is a perspective view showing the state where the coil is formed by winding the conductive wire around the bobbin part in the electroacoustic transducer according to the embodiment of the invention.

The coil 41 is formed of the conductive wire 42 wound around the extended portions 27 of the bobbin part 24, as shown in FIGS. 8 and 9, and disposed on the base portions 26. In the embodiment, a copper wire having a wire diameter of about 60 $\mu$m is employed as the conductive wire 42, and an insulating layer is provided around the copper wire. A height of the coil is set at a value (about 2.9 mm, in this embodiment) smaller than the length of the extended portions 27.

In the embodiment, the coil 41 is not get in touch with the base 33 (the pole piece 31), because the heights of the base portions 26 are set at a value larger than a thickness of the base 33. Further, since the bobbin part 24 (the extended portions 27) is divided into a plurality of pieces in the circumferential direction of the core 32, the bobbin part 24 (the extended portions 27) is intermittently arranged as seen in the circumferential direction of the core 32. Accordingly, when the conductive wire 42 is wound around the bobbin part 24 (the extended portions 27), the conductive wire 42 is wound rectilinearly in areas between the divided pieces of the extended portions 27.

The lower case 21 is provided with lead terminals 28, 29 as terminal parts for the coil 41, in an integrated state, by a so-called "insert molding method". The conductive wire 42 drawn out from the coil 41 passes the projection 23 formed on the lower case 21 to be guided to lands 28*a*, 29*a* of the lead terminals 28, 29 through a cut out 30 formed in the wall 22, as shown in FIGS. 8 and 9. The end portions of the conductive wire 42 are fixed by soldering to the lands 28*a*, 29*b* in this state. The cut out 30 formed in the wall 22 is sealed with silicone material (not shown).

Reference should be made again to FIGS. 2 and 3. The magnet 51 is an annular plastic magnet, and arranged around the coil 41 so as to leave a determined space from the coil 41. The magnet 51 is abutted against and mounted on the base 33 of the pole piece 31, and abutted against the wall 22 of the lower case 21 to restrict the mounting position thereof.

The magnet 51 has a stepped portion 52, on which a diaphragm 61 is mounted. In the embodiment, the magnet 51 functions also as a support member for supporting the diaphragm 61. A magnetic piece 62 is provided as an additional mass at a center part of the diaphragm 61. The diaphragm 61 is in an attracted state by a static magnetic field of the magnet 51, and fixed in a state that the diaphragm 61 is attracted toward the magnet 51. The stepped portion 14 of the upper case 11 restricts upward movement of the diaphragm 61.

A rear space A is defined at a rear face side of the diaphragm 61. A resonant space B is defined at an upper face side of the diaphragm 61, and covered with the upper case 11. The resonant space B is open to an outside air through the sound emitting tube 13, that is, through the sound emitting hole 12 formed in the upper case 11.

An operation of the electroacoustic transducer T constructed will be described. The base 33, the core 32, the diaphragm 61 and the magnet 51 constitute a magnetic circuit in the electroacoustic transducer T. The static magnetic field by the magnet 51 acts on the diaphragm 61. The diaphragm 61 which has been magnetized is attracted toward the core 32. The magnet 51 acts on the diaphragm 61 as a bias magnetic field.

When an electric signal such as an alternating current or pulse is applied between the lead terminals 28, 29 to a unidirectional magnetic field composed of such a static magnetic field. A vibrating magnetic field corresponding to the electric signal is generated in the core 32. The diaphragm 61 oscillates in a direction away from the core 32 when a direction of the vibrating magnetic field is opposite to the direction of the static magnetic field of the magnet 51. The diaphragm 61 is attracted toward the core 32 when the direction of the vibrating magnetic field is the same as the direction of the static magnetic field. Such upward and downward mechanical movements depend on a frequency of the electric signal. Accordingly, the diaphragm 61 oscillates to vibrate air. The vibration is amplified as a resonant sound in the resonant space B. The sound is emitted to the exterior mainly through the sound emitting hole 12.

In the present embodiment, such a risk that the conductive wire 42 drawn out from the coil may get in touch with the base 33 is avoided, by presence of the projection 23 which is integrally formed on the lower case 21 (the case 1) formed of resin material (the thermoplastic resin) which is lower in hardness than the base 33. The projection 23 serves as a guide part for preventing the conductive wire 42 from getting in touch with the base 33. Accordingly, the conductive wire 42 (the coating layer thereof) can be prevented from being damaged through a contact with the base 33. Accordingly, there is no risk that the metallic parts of the base 33 and so on may come into contact with the damaged conductive wire 42 and a short circuit may occur or the conductive wire 42 may be broken. Decrease in reliability and durability of the electroacoustic transducer T can be thus restrained.

In the embodiment, the case 1 includes the upper case 11 and the lower case 21 provided with the lead terminals 28, 29, and the base 33 (the pole piece 31) is disposed on the lower case 21. Moreover, because the projection 23 is integrally formed with the lower case 21, and particularly, the height of the projection 23 has the value larger than the height of the surface of the base 33, the structure of the projection 23 which can prevent the conductive wire 42 from getting in touch with the base 33 can be realized in a simple form and at a low cost. Even in case where the height of the projection 23 and the height of the surface of the base 33 are equal, the conductive wire 42 comes into contact only with the projection 23 when the conductive wire is drawn from the top of the coil 41 or when the conductive wire is drawn from the bottom of the coil 41 which is not in contact with the base 33. Consequently, the conductive wire 42 can be prevented from getting in touch with the base 33.

Further, because the projection is integrally formed with the lower case 21 (the case 1) formed of the resin material (the thermoplastic resin), there is no need of newly providing a component constituting the projection 23, nor an additional step of providing the projection 23 on the lower case 21 by adhesion or the like. Accordingly, the projection 23 can be provided on the lower case 21 in a simple form and at a low cost.

Still further, since there is formed, in the base 33, the cut out 34 which can be engaged with the projection 23, positioning of the base 33 (the pole piece 31) can be reliably and easily conducted, when mounting the base 33 (the pole piece 31) on the lower case 21. Moreover, by forming the cut out 34 in the base 33, the capacity of the base 33 can be decreased. As the results, the capacity of the rear space A in the electroacoustic transducer T can be increased, and its sound pressure performance, especially, the sound pressure performance in a bass range can be enhanced.

The invention is not limited to the above described embodiment, but can be appropriately modified with respect to the above described numerical values, shapes of the constituent elements (for example, a shape of the projection 23, dividing number). Preferably, the width and height of the projection 23 are set to be as small as possible as far as a contact between the conductive wire 42 and the base 33 can be prevented, so that decrease in the capacity of the rear space in the electroacoustic transducer and deterioration of the sound pressure performance may be restrained. Although the length of the projection 23 is required to be enough to support the conductive wire 42 even when the position of the conductive wire 42 is displaced, the length of the projection 23 should be preferably set, taking the above described deterioration of the sound pressure performance into consideration.

Although the projection 23 is integrally formed with the lower case 21 (the case 1) in this embodiment, the invention is not limited to such a structure. For example, the projection 23 may be provided as a separate body from the lower case 21 (the case 1), and attached to the lower case 21 by adhesion or the like to be fixed thereto. The material for composing the projection 23 is not limited to the resin material (the thermoplastic resin), but may be any material, provided that the material has a hardness lower than the base 33. More preferably, the material may have a hardness lower than the coating layer of the conductive wire 42.

Although the present embodiment is so constructed that there is provided the bobbin part 24 for the conductive wire 42 to be wound around it, the invention is not restricted to such a structure. The coil 41 maybe composed by directly winding the conductive wire 42 around the core 32 of the pole piece 31, or the conductive wire 42 which has been wound in advance in a coreless manner may be mounted on the core 32.

Further, there is formed the cut out 34 in the base 33 in this embodiment. This cut out 34 may preferably have such a size that the conductive wire 42 may not get in touch with the base 33, and in this manner, it is possible to obtain a sufficient magnetic saturation capacity with the base 33.

Although, in this embodiment, the guide part is constituted by forming the projection 23, the invention is not limited to such a structure, but the guide part may be formed in such a manner that at least a part of the surface of the base 33 is covered the lower case or and extension thereof.

As fully described herein above, according to the invention, it is possible to provide the electroacoustic transducer in which damages of the conductive wire composing the coil can be prevented, and decrease in reliability and durability can be restrained.

What is claimed is:

1. An electroacoustic transducer comprising:

a pole piece including a core and a base;

a coil composed of a winding of a conductive wire and disposed around the core;

a magnet disposed around the coil;

a guide part for preventing the conductive wire from getting in touch with the base, the guide part being formed of material having a lower hardness than the base.

2. The electroacoustic transducer as claimed in claim 1, wherein the guide part prevents a portion of the conductive wire drawn out from the coil from getting in touch with the base.

3. The electroacoustic transducer as claimed in claim 2, wherein the electroacoustic transducer further comprises a case includes an upper case, and a lower case having a coil terminal to which the end portion of the conductive wire is electrically connected, the base is placed on the lower case, and the guide part is provided on the lower case and has a height equal to or higher than a top surface of the base.

4. The electroacoustic transducer as claimed in claim 3, wherein the guide part is integrally formed on the lower case.

5. The electroacoustic transducer as claimed in claim 3, wherein the base has a cut out being engagable with the guide part.

6. The electroacoustic transducer as claimed in claim 4, wherein the base has a cut out being engagable with the guide part.

* * * * *